United States Patent [19]

Statnic et al.

[11] Patent Number: 4,775,822

[45] Date of Patent: Oct. 4, 1988

[54] POWER NETWORK FLUORESCENT LAMP OPERATING CIRCUIT

[75] Inventors: Eugen Statnic, Munich; Wolfgang Tausch, Unterhaching; Water Hirschmann, Munich, all of Fed. Rep. of Germany

[73] Assignee: Patent-Treuhand Gesellschaft fur Elektrische Glühlampen GmbH, Munich, Fed. Rep. of Germany

[21] Appl. No.: 48,005

[22] Filed: May 8, 1987

[30] Foreign Application Priority Data

May 9, 1986 [DE] Fed. Rep. of Germany ..... 3615605

[51] Int. Cl.[4] ..... H05B 37/00

[52] U.S. Cl. ..... 315/224; 315/244; 315/290; 315/292; 315/226; 315/DIG. 7

[58] Field of Search ..... 315/244, 209 R, 200 R, 315/DIG. 7, DIG. 5, 210, 290, 242, 226

[56] References Cited

U.S. PATENT DOCUMENTS

| | | | |
|---|---|---|---|
| 4,042,856 | 8/1977 | Steigerwald | 315/307 |
| 4,358,712 | 11/1982 | Filgas et al. | 315/244 |
| 4,362,971 | 12/1982 | Sloan | 315/244 |
| 4,398,126 | 8/1983 | Zuchtriegel | 315/127 |
| 4,398,128 | 8/1983 | Wollank | 315/209 R |
| 4,438,372 | 3/1984 | Zuchtriegel | 315/224 |
| 4,547,706 | 10/1985 | Krummel | 315/226 |
| 4,553,070 | 11/1985 | Sairanen et al. | 315/209 R |
| 4,572,989 | 2/1986 | Zuchtriegel | 315/209 R |
| 4,608,523 | 8/1986 | Nilssen | 315/244 |
| 4,647,817 | 3/1987 | Fahnrich et al. | 315/244 |

*Primary Examiner*—David K. Moore
*Assistant Examiner*—Michael Razavi
*Attorney, Agent, or Firm*—Frishauf, Holtz, Goodman & Woodward

[57] ABSTRACT

To operate a fluorescent lamp having a lamp operating voltage of to about 150 V from a power supply having a nominal voltage level below lamp operating voltage, and without use of a voltage doubler circuit or a transformer to increase the power supply voltage, the power supply voltage is rectified, chopped, and then applied to the fluorescent lamp through a voltage increasing circuit which is formed as an LC resonance circuit. The inductive component can be formed by the current limiting choke, already present in a typical fluorescent lamp circuit, and the capacitative component by a small capacitor, for example of 6 nF value, connected to the choke to form a series resonance circuit.

2 Claims, 4 Drawing Sheets

POWER NETWORK FLUORESCENT LAMP OPERATING CIRCUIT

Reference to related literature:

U.S. Pat. No. 4,438,372, Zuchtriegel;

U.S. Pat. No. 4,647,817, Fahnrich et al, both assigned to the assignee of the present application, the disclosure of which is hereby incorporated by reference.

U.S. Pat. No. 4,481,460, Krüning et al, the disclosure of which is hereby incorporated by reference.

"SIPMOS Transistors", SIEMENS Application Notes 1983, chapter 1.9, "Electronic ballast for fluorescent lamps", pp. 34 et seq.

and equivalent general disclosure "Elektronischaltungen" ("Electronic Circuits") by Walter Hirschmann, published by SIEMENS AG, chapter B3.12, "Elektronisches Vorschaltgerüt für neue Leuchtstofflampen" ("Electronic Ballast for New Fluorescent Lamps") 50 W/220 V, a-c, pp. 144 to 151.

U.S. Pat. No. 4,544,863, Hashimoto.

Reference to related applications:

U.S. Ser. No. 023,456, filed Mar. 9, 1987, now U.S. Pat. No. 4,710,682, Zuchtriegel U.S. Ser. No. 023,481, filed Mar. 9, 1987, Fahnrich et al both assigned to the assignee of the present application.

The present invention relates to a fluorescent lamp operating circuit, and more particularly to an electronic ballast circuit permitting operation of fluorescent lamps from power networks which have a nominal network voltage which is about the same, or even lower than the lamp operating voltage.

BACKGROUND

Electronic operating circuits for fluorescent lamps of the type to which the present invention relates, usually include a rectifier circuit to which alternating power from network lines is applied. The rectified voltage is chopped to provide an output at a frequency which is substantially higher than the frequency of the power network voltage. A current limiting circuit receives the chopped output and applies it to one terminal, each, of the lamp electrodes. The other terminals of the lamp electrodes are connected to an ignition or starting circuit. This arrangement is well known and FIG. 1—to be described in greater detail hereafter—shows such a prior art arrangement.

Fluorescent lamps, in dependence on structure and gas fill, have lamp operating voltages between 30 and 150 $V_{eff}$(effective voltage). The peak-to-peak voltage of the highfrequency alternating voltage $U_L$, applied to the lamp, may be higher than the lamp voltage by a factor of about 3—in dependence on the wave shape. Thus, the high-frequency voltage may have values of between 90 to 450 volts peak-to-peak, herein referred to as $V_{SS}$. The circuits usually required at the network voltage for the lamp circuit is higher than the maximum lamp operating voltage.

Operation of lamps at power network voltages customary in the United States and Canada, for example, in the order of, effectively, 100 to 120 V, results in problems. Filtered direct current voltage can be derived from the rectifiers at levels of only about 130 to 160 V. Fluorescent lamps which only have low operating voltage, that is, less than 100 $V_{SS}$, can be operated after chopping with a current limiting choke without using special circuit arrangements. Only if the network voltage is slightly higher than lamp operating voltage is it possible to consistently and reliably operate such fluorescent lamps.

Fluorescent lamps have a negative impedance characteristic. This negative impedance characteristic obtains already if the lamp operating voltage $U_{LSS}$, that is, the peak-to-peak voltage during operation, is only slightly below the chopped direct current voltage $U_{SS}$. Due to the negative impedance characteristic, operation will be unstable. Only current limiting chokes with very small inductivity can be used. Lamps with lamp operating voltages which are higher than the network voltages, that is, lamps having operating voltages of between for example 120 to 450 $V_{SS}$, cannot be operated at all utilizing current limiting merely by means of a choke.

It is possible to step up the d-c voltage by a voltage doubler rectifier circuit, for example of the type known as a Villard or a Delon circuit—see, for example, "Bauelemente der Elektronik und ihre Grundschaltungen" ("Components in Electronics and Basic Circuits Therefor"), by Büser, Kähler, Weigt, 7th edition, page 220. To obtain such high voltages, however, it is necessary to use high capacity values of electrolytic capacitors, or a hum voltage of 60 or 120 Hz will obtain with a 60-cycle supply. The light flux modulation is increased.

It is, of course, possible to transform the chopped essentially square-wave voltage by a transformer; the referenced literature "Elektronischaltungen" ("Electronic Circuits") by W. Hirschmann, page 144 shows such an arrangement. This, however, has a disadvantage in that a wound wire component must be used. This increases costs, and causes additional losses, so that the overall efficiency of the electronic circuit - lamp combination is decreased.

U.S. Pat. No. 4,544,863 describes an auxiliary circuit for fluorescent lamps in which a power network voltage of low frequency, for example 60 Hz, is transformed into a high-frequency voltage, suitable for fluorescent lamp operation. This high-frequency voltage is applied to the fluorescent lamp via an inductance and a capacitor. The inductance and capacitor are connected in series. This circuit operates with a separately controlled oscillator, requiring precise dimensioning of the components of the auxiliary circuit. The result is an arrangement which is specific to certain lamps; and the circuit is not readily adaptable, flexibly, to various lamps.

THE INVENTION

It is an object to provide a self-starting flexible electronic auxiliary network to operate fluorescent lamps in which, easily and simply, the supply voltage is so increased for the lamp circuit that the lamp will operate satisfactorily; and, particularly, to permit operation of lamps with high lamp operating voltages from power networks of intermediate voltage level, for example 110 V at 60 Hz.

Briefly, the voltage which is obtained at the output of the current limiting circuit is increased before it is applied to the fluorescent lamp. In accordance with a preferred embodiment, this voltage increase is obtained by utilization of an LC resonance circuit, the fluorescent lamp being connected in parallel to the capccitor of the resonant circuit.

The auxiliary circuit which, apart from the voltage increasing arrangement, may be standard or in accordance with the prior art, permits automatic matching of the lamp to the circuit and self-starting of the circuit. It has the advantage that, with respect to prior art circuits, only few components are required, which do not have to be constructed with tight tolerances but, rather, may be dimensioned liberally. The circuit, thus, will be sturdy, reliable, readily adapted to various lamps, and inexpensive.

DRAWINGS

DETAILED DESCRIPTION

Figure 1:
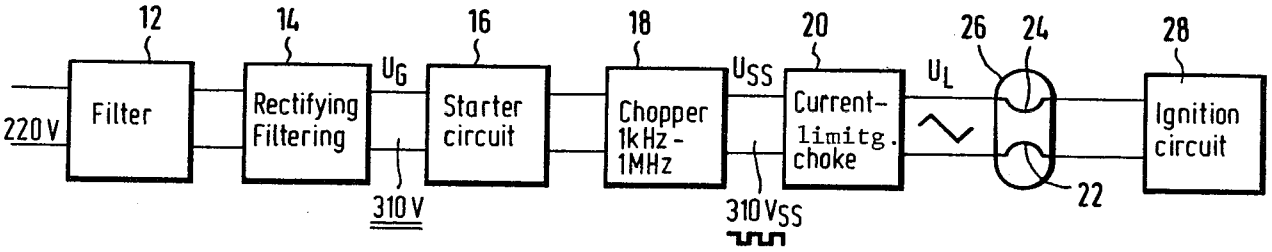
FIG. 1 PRIOR ART
FIG. 1 is a basic circuit diagram in accordance with the prior art illustrating a circuit in which the output voltage is substantially above lamp operating voltage.

FIG. 1, illustrating a prior art circuit, shows that a supply network of, for example, 220 V nominal, is connected to a filter circuit 12, the output of which is rectified and filtered in a unit 14, supplying a rectified direct current voltage $U_G$ of, for example, 310 V. This voltage is applied to a starter circuit 16 and, in turn, to a chopper 18. The chopper operates at a rate of between 1 kHz to about 1 mHz. In some embodiments, a suitable frequncy is about 50 kHz. The output from the chopper 18 will be at a voltage amplitude $V_{SS}$ of 310 V peak-to-peak. This voltage is applied over a current limiting choke 20 to one terminal of electrodes 22, 24 of a fluorescent lamp 26. The other terminals of the electrodes 22, 24 are connected to an ignition or starting circuit which may include a capacitor of, for example, a few nF.

The fluorescent lamp 26 may have an effective lamp operating voltage between 30 and 100 $V_{eff}$. The voltage derived from the chopper 18, as can be seen, is substantially in excess of even the highest lamp operating voltage.

Figure 2:
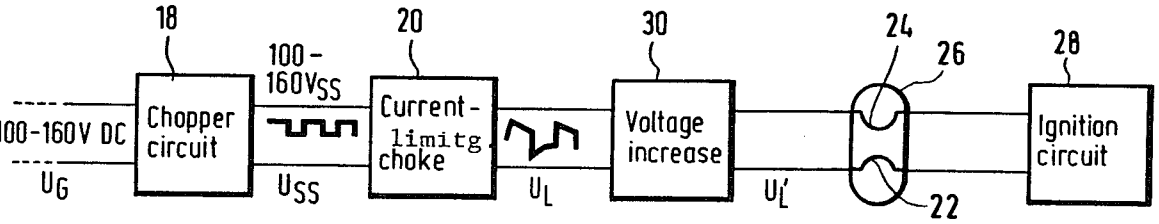
FIG. 2 is a fragmentary diagram illustrating the modification of the prior art diagram of FIG. 1 in accordance with the present invention.

FIG. 2 illustrates the portion of the circuit between the chopper 18 and the lamp 26 modified to receive a d-c voltage $U_G$ from the rectifying filter of, for example, only 100 to 160 V d-c, rather than the substantially higher voltage of 310 V shown in FIG. 1. The input of the chopper 18, thus, has a filtered d-c voltage $U_G$ of 100 to 160 V applied. Such a voltage is readily obtainable from a power network having an effective voltage of between 75 to 120 V, for example, by rectification and subsequent filtering.

The chopper circuit 18 supplies a sequence of essentially square-wave pulses having a peak-to-peak voltage $U_{SS}$ of between 100 and 160 volts. This voltage $U_{SS}$ is applied to a current limiting circuit 20, preferably in form of a choke, as in the circuit of FIG. 1. The output from the choke 20 will be a modified wave $U_L$ due to the inductance of this choke.

In accordance with the present invention, a voltage enhancing or increasing circuit 30 is introduced in the circuit of the lamp in advance of the lamp and behind the current limiting circuit 20. The inputs of the voltage increasing circuit 30 are connected to receive the voltage $U_L$ from the current limiting stage 20. The two output terminals of the voltage increasing circuit 30 provide a voltage $U_L'$ which is applied to one terminal each of the electrodes 22, 24 of the lamp 26, that is, similar to the prior art circuit in FIG. 1. The other terminals of the lamp electrodes 22, 24 are connected to an ignition or starter circuit, as well known in accordance with the prior art.

The circuit of FIG. 1 which, for example, may be similar to the circuit described in the literature reference of the book by Hirschmann, is modified by the introduction of the voltage increasing circuit 30 at the particular position shown in FIG. 2 and described above.

Figure 3:
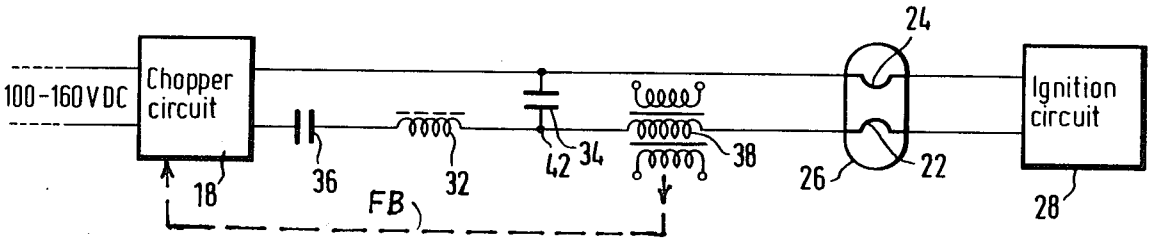
FIG. 3 is a detailed circuit diagram of a component of the circuit of FIG. 2.

The voltage increasing circuit 30 is shown in detail in FIG. 3, which also shows the elements of the fluorescent lamp circuit to which the voltage increasing circuit is connected.

FIG. 3, thus, again shows the input to the chopper circuit 18 at between 100 to 160 V d-c. This circuit, as can be seen from FIG. 3, is simple. The choke 32 illustrated in FIG. 3 may be the same choke used as the current limiting choke 20 which, however, and in accordance with a feature of the invention, has a capacitor 34 associated therewith to form a resonant circuit. Suitable values are: inductance $L_{Dr}$ of choke 32: 1.7 mH capacity $C_R$ of capacitor 34: 3.3 nF.

In accordance with the embodiment of FIG. 3, capacitor 34 has one terminal connected to a terminal of the electrode 24 of the lamp 26. The other electrode 22 has its similar or matching terminal connected to the primary winding of a transformer 38, used to control the chopper circuit. The capacitor 34 is connected to the junction 42 between the choke 32 and the primary winding of the transformer 38.

The chopper 18 has one terminal connected to one terminal of the capacitor 34 and hence to the electrode 24 of the lamp 26. The other terminal of the chopper circuit 18 is connected through an isolating or separating capacitor 36 to the aforementioned choke 32, forming the current limiting circuit 20 and through the choke 32 to the junction 42.

A series resonant circuit is formed by the choke 32 and the capacitor 34. A series resonsance circuit is also formed by the inductance of the transformer 38 and the capacitor 34. In the embodiment in accordance with the invention, a feedback signal can thus be obtained from the transformer 38 for the chopper circuit 18.

The circuit has the additional advantage that upon disconnection of the lamp 26, removal of the lamp 26 from its sockets or failure of the lamp 26, for example upon break or burn-out of the filament, the chopper circuit is automatically disconnected since the transformer winding 38 will be deenergized. Thus, the electronic accessory or auxiliary circuit automatically disconnects upon failure or malfunction or burn-out of the lamp.

The feedback from the transformer 38 to the chopper circuit is schematically indicated by broken line FB.

OPERATION

The operating frequency of the accessory apparatus, or a multiple or harmonic of the operating frequency, is placed in the vicinity of the basic resonance frequency of the series resonant circuit, or exactly thereon in accordance with the relationship:

$$f_{res} = \frac{1}{2\pi\,(L_{Dr}C_R)^{0.5}} \quad (1)$$

The resonant circuit will hold a predetermined energy W, dependent on its dimensioning. The energy will be stored, alternately, in the electrical and magnetic field in accordance with the relationship:

$$W = W_{el} = \frac{1}{2}\,CU^2 = W_{mag} = \frac{1}{2}\,LI^2 \quad (2)$$

wherein C is the capacity of the capacitor 42, U is the voltage, and L is the inductance of the choke 32.

The voltage across the capacitor 34, that is, at the input to the lamp 26, will be:

$$U_L' = I\left(\frac{L}{C}\right)^{0,5} \quad (3)$$

The level of the voltage at the capacitor 34 depends on the peak-to-peak output voltage $U_{SS}$ from the chopper 18 and on the relationship $L_{Dr}/C_r$.

The foregoing clearly shows that the lamp 26 can have a higher voltage supply $U_L'$ applied thereto without problems or substantial use of circuit components, which voltage is higher than the lamp operating voltages, and which may well be higher than any lamp operating voltage.

The ignition pulse required to fire the fluorescent lamp 26 requires a still higher voltage; this pulse can be easily obtained. If the ignition circuit is capacitative, then—due to the parallel connection of the two capacitors an increased overall capacitance $C=C_R+C_Z$ will obtain, and thus a correspondingly lower second resonant frequency. After ignition, the resonant circuit 32, 34 is damped by the equivalent impedance of the lamp, and the voltage across capacitor 34 is determined by the lamp parameters. The quality of the resonant circuit 32, 34 will drop automatically to the desired value.

Figure 4:
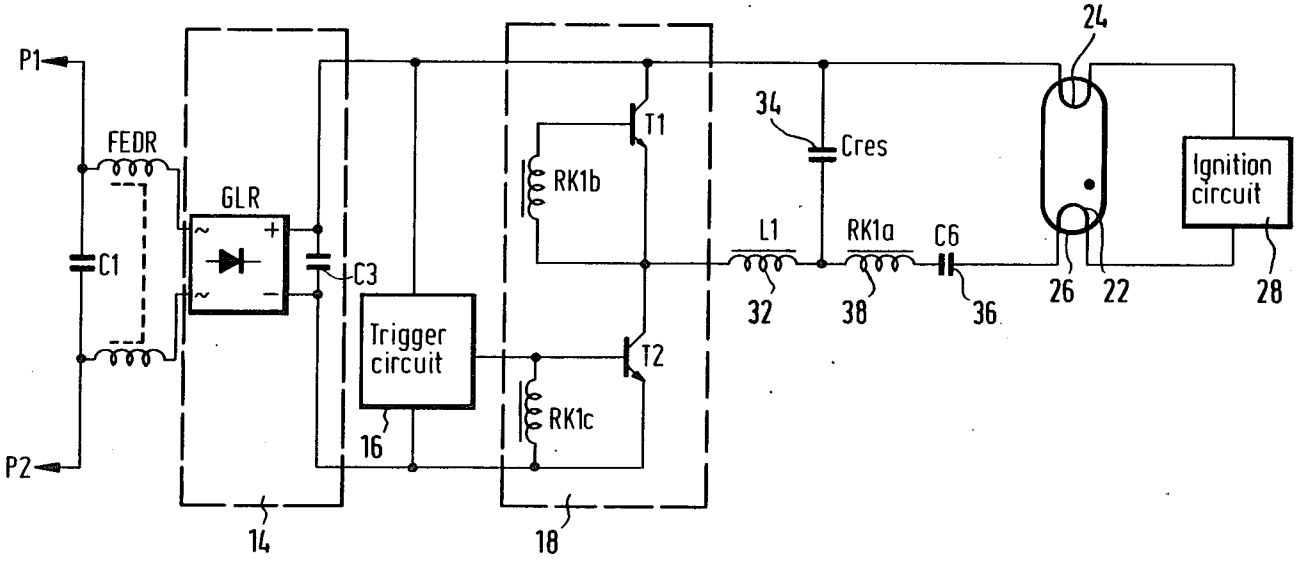
FIG. 4 is a diagram in which the overall circuit is expanded to show the entire circuit adapted for connection to a power network.

A detailed circuit in accordance with the invention is shown in FIG. 4, in which the capacitor 36, also labeled as C6, is placed between the transformer 38 and one terminal of the electrode 22 of lamp 26. This embodiment also illustrates, in detail, components which previously were shown only in block representation.

The chopper circuit 18 is shown as a freely oscillating push-pull path bridge circuit having two bipolar switching transistors T1, T2. Capacitor C1 in the input circuit and inductances FEDR also connected to the input circuit are used to suppress radio interference. The circuit can be connected at terminals P1 and P2 to a power network, for example 110 V, 60 Hz. The input power, suitably filtered by the capacitor C1 and the inductances FEDR, is rectified in a rectifier GLR, which provides at its output a d-c voltage of about 160 V. This voltage is applied to the chopper circuit 18, which includes the two transistors T1, T2 and secondary or feedback windings RK1b and RK1c, which are inductively coupled to the transformer 38, shown as having a winding RK1a.

OPERATION

The circuit 16 is started by a single pulse, for example upon connection thereof to the power network at terminals P1, P2. An approximately square-wave high-frequency voltage will then be available at the center junction of the transistors T1, T2, of about 160 V peak-to-peak, with respect to the positive or negative terminal of the power supply, respectively. The frequency of this essentially square-wave voltage will depend on the state or condition of the load placed thereon.

Upon starting, a series resonant circuit formed by the choke 32 and the parallel connection of capacitor 34 with the capacitative portion of the ignition circuit will become operative. The inductance of the choke 32 is shown, schematically, as L1, and the capacity of capacitor 34 as $C_{res}$. The capacity of capacitor 34, for example, is about 6 nF. The d-c isolating capacitor 36, having a capacity C6 of 47 nF, is connected in series thereto. Since the capacity C6 of the isolating capacitor of 47 nF is large with respect to the capacity $C_{res}$ of capacitor 34, the effective capacity is, as above, about 6 nF. The primary winding RK1a of the transformer 38 is also connected serially with the ignition circuit 28, as well as the electrode 22 of the lamp 26. The transformer 38 controls, via the secondary windings RK1b and RK1c, switching of the respective half-bridge transistors and insures maintenance of continued oscillations. The resonant circuit, above described, is only slightly damped by the electrode in a respective branch thereof. Consequently, and as above noted, the operating frequency will be close to the base resonance frequency of the series resonance circuit.

Upon continued heating of the electrodes, and in a second phase of the heating portion during starting of the lamp, the capacitative portion of the ignition circuit will decrease to about 3 nF. This decreases the heating current and simultaneously decreases damping. A substantial increase in the quality of the resonant circuit will occur, and the voltage at the lamp will also increase. This process continues until the ignition or firing voltage of the lamp 26 is reached. At that time, the lamp has been optimally preheated. When the ignition voltage is reached, an arc discharge within the lamp will occur and, at that point, the highest frequency will be generated.

In continued operation of the lamp, the resonant circuit will be damped by the relative low resistance arc discharge. This frequency is substantially lower than the resonance frequency. Yet, the effect of the resonant circuit is strong enough to operate fluorescent lamps, having peak operating voltages which are clearly and markedly above the supply voltage. This operation is not possible with a circuit which does not include the resonance effect, for example with a purely inductive circuit.

In accordance with the invention, the operating mode of the circuit thus is changed to resonant operation. The only additional component necessary is the capacitor 34, which has a low value of capacitance, as above noted of about 6 nF. It forms, together with the choke 32 which is present anyway, the resonant circuit. It is of importance that the frequency of the freely oscillating circuit can follow or adapt itself automatically to the requirements. In a typical operation, under preheating conditions, the frequency rises continuously from about 40 kHz until ignition voltage is reached at about 50 kHz, to then drop off for normal lamp operation to about 35 kHz.

If the lamp 26 should fail, the circuit must be disconnected in order to prevent operation under undamped condition. Otherwise, the chopper circuit, including the transistors, may be excessively loaded, which may lead to damage or destruction thereof. Disconnection is obtained by so connecting the primary winding of the oscillation transformer 38 that only lamp and/or heater current flows therethrough. In this embodiment, the primary winding RK1a is placed in circuit behind the branching of the capacitor 34 from choke L1. Thus, the embodiment provides that upon failure of the lamp 26, feedback of lamp current to the secondary windings controlling the transistors T1, T2 will stop, so that the chopping and oscillations of the chopper 18 will stop.

Figure 5:
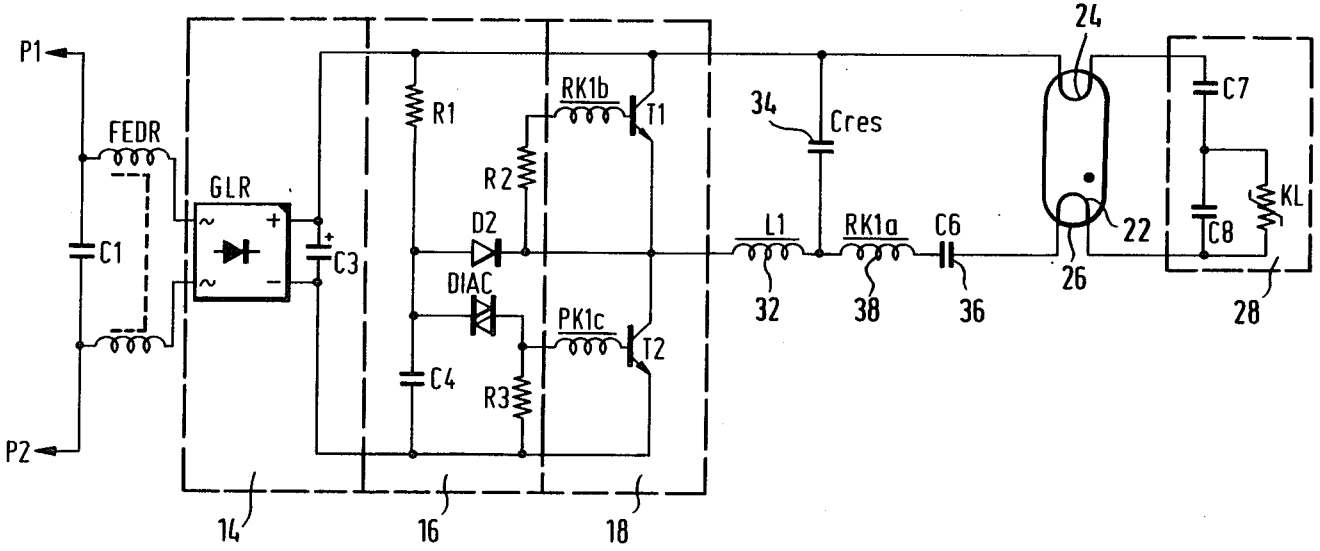
FIG. 5 illustrates the circuit of FIG. 4, in which the starting trigger circuit is likewise shown in detail.

FIG. 5 illustrates the structure of FIG. 4 in greater detail, by showing, in addition to the elements discussed in FIG. 4 (which have been given the same reference numerals), also the details of the ignition circuit 28, as well as the details of the starter or trigger circuit 16. The expansion of FIG. 4 to FIG. 5, essentially, merely incorporates the disclosure of the cited literature "Electronic Circuits" by Hirschmann, referenced above, to provide a complete integrated patent disclosure. Thus, the trigger circuit 16 includes a diac connected to the base of the transistor T2 to provide a starter pulse, an R/C circuit formed by resistor R1 and C4, and a diode D2 connected between the junction of the resistor R1 and capacitor C4 and the center junction of the two transistors T1, T2. FIG. 5 additionally shows the base resistors R2, R3 of the transistors T1, T2. The trigger circuit 28 itself includes capacitors C7, C8 and a positive temperature resistor KL, connected across capacitor C8. The ignition circuit is described and shown in detail in the referenced U.S. Pat. No. 4,467,817, Fahnrich, Roll and Statnic, assigned to the assignee of the present application, and the disclosure of which is hereby incorporated by reference. A further discussion of the operation of the ignition circuit, thus, is not needed.

Various changes and modifications may be made within the scope of the inventive concept.

We claim:

1. Power network fluorescent lamp (26) operating circuit, adapted for connection to a power network, having means (14) for supplying d-c power at a first voltage level;

a lamp circuit including first and second electrodes (22,24) of a fluorescent lamp (26);

a chopper circuit (18) receiving said d-c power, said chopper circuit having a first output terminal supplying a train of pulses at a frequency high with respect to power network frequency, and having a seond output terminal connected to the second electrode (24) of the fluorescent lamp (26);

a current limiting choke element (20);

a lamp ignition or starter circuit (28) connected to the lamp electrodes;

a feedback control transformer (38) having a primary winding (RK1a) and a secondary winding means (RK1b, RK1c), said secondary winding means being coupled to and providing feedback energy to said chopper circuit (18); and a d-c blocking capacitor (36, C6) serially connected between the first output terminal of said chopper circuit (18) and said serially connected choke element (20) and the primary winding (RK1a) of said feedback transformer;

a fail safe voltage enhancing or increasing circuit (30) for permitting operating of a fluorescent lamp (26) having a lamp operating voltage in the range of or in excess of said voltage level including a series resonant capacitor (34) and said choke element (20), and wherein the primary winding (RK1a) of the feedback control transformer and the choke element (20) are serially connected, define a common junction (42) and said serially connected primary winding and choke element are connected between the first output terminal of the chopper circuit (18) and the first electrode (22) of the lamp, said series resonant capacitor (34) has one electrode connected to said common junction (42) and a second electrode connected to the second electrode (24) of said lamp and second output terminal of the chopper circuit (18), and wherein the capacity value of said blocking capacitor (36, C6) is high with respect to the capacity value of said series resonant capacitor (34).

2. The circuit of claim 1 wherein each of said lamp electrodes (22, 24) has an input terminal; and wherein said choke element (32) is connected to the first output terminal of said chopper circuit (18) and to said common junction (42) which common junction, in turn, is connected to a terminal of said capacitor (32) and to a terminal of the primary winding (RK1a) of said feedback transformer (38), the other terminal of said primary winding of said feedback transformer being connected to one terminal of the first electrode (22) of the lamp.

* * * * *